United States Patent [19]

Gill

[11] Patent Number: 4,987,725

[45] Date of Patent: Jan. 29, 1991

[54] METHOD OF MANUFACTURING AND FILLING CONTAINER

[75] Inventor: David C. Gill, Bristol, Great Britain

[73] Assignee: Nomix Manufacturing Company Limited, Staple Hill, United Kingdom

[21] Appl. No.: 321,574

[22] Filed: Mar. 9, 1989

[30] Foreign Application Priority Data

Mar. 16, 1988 [GB] United Kingdom ..... 8806256

[51] Int. Cl.[5] ..... B65B 47/02

[52] U.S. Cl. ..... 53/453; 53/559; 493/85; 493/211; 493/339

[58] Field of Search ..... 53/453, 452, 561, 559; 264/516; 493/85, 211, 339, 338

[56] References Cited

U.S. PATENT DOCUMENTS

| | | | |
|---|---|---|---|
| 3,142,599 | 7/1964 | Chavannes | 156/210 |
| 3,325,082 | 6/1967 | Naylor | 229/55 |
| 3,695,507 | 10/1972 | Sams | 229/53 |
| 3,743,172 | 7/1973 | Ackley et al. | 229/55 R |
| 4,257,530 | 3/1981 | Faller | 220/469 |
| 4,543,770 | 10/1985 | Walter et al. | 53/561 X |
| 4,603,541 | 8/1986 | Medwed | 53/561 |
| 4,684,025 | 8/1987 | Copland et al. | 53/559 X |
| 4,685,274 | 8/1987 | Garwood | 53/453 X |
| 4,796,408 | 1/1989 | Mobark | 53/453 X |

FOREIGN PATENT DOCUMENTS

| | | |
|---|---|---|
| 068718 | 6/1982 | European Pat. Off. . |
| 085534 | 1/1983 | European Pat. Off. . |
| 0194871 | 9/1986 | European Pat. Off. . |
| 219758 | 4/1987 | European Pat. Off. . |
| 2641484 | 3/1978 | Fed. Rep. of Germany . |
| 2127507 | 9/1972 | France . |
| 1075221 | 8/1964 | United Kingdom . |
| 1029870 | 4/1965 | United Kingdom . |
| 1434967 | 12/1972 | United Kingdom . |
| 1472178 | 8/1973 | United Kingdom . |
| 2001934 | 6/1977 | United Kingdom . |
| 1586437 | 3/1978 | United Kingdom . |
| 2041318 | 9/1980 | United Kingdom . |
| 2111939 | 7/1983 | United Kingdom . |
| 2171383 | 2/1985 | United Kingdom . |
| 8501269 | 3/1985 | World Int. Prop. O. . |

*Primary Examiner*—James F. Coan

*Attorney, Agent, or Firm*—Merchant, Gould, Smith, Edell, Welter & Schmidt

[57] ABSTRACT

A container, for example for herbicide, is manufactured by securing a flexible wall (8) to a rigid housing part (2), and subsequently deforming the flexible wall (8), in a plastic manner, into a predetermined configuration. A further housing part, possibly complementary to the housing part (2), may then be applied to the housing part (2) in order to provide a closed chamber which is divided by the flexible wall (8) into two compartments. The flexible wall (8) is preferably deformed into a configuration which enables it to lie, unstressed, against the internal surface of the housing part (2), so that herbicide contained in the cavity between the housing part (2) and the flexible wall (8) can flow substantially completely from the container under gravity.

12 Claims, 2 Drawing Sheets

METHOD OF MANUFACTURING AND FILLING CONTAINER

This invention relates to a method of manufacturing containers, and is particularly, although not exclusively, concerned with the manufacture of containers for herbicide, in which containers the herbicide can be packaged for sale and from which the herbicide can be passed directly to a delivery device, without dilution or mixing with other components, for distribution over the ground.

There exist hand-held lances for delivering herbicide which comprise a handset and a delivery head which is connected to the handset by a tubular support. The handset is held by the operator and the tubular support enables him to position the delivery head just above the ground to be treated.

It is conventional for the herbicide to be supplied to the lance from a container which may be supported over the shoulder of the operator or carried in a backpack. One form of known container is a collapsible bag, for example, of plastics material, which is accommodated in a rigid casing, such as a cardboard box. Such containers are similar to those which are sometimes used for packaging wine. This however is a relatively expensive form of packaging, since it is necessary not only to form and fill the bags, but also to form the cardboard boxes and then to insert the filled bags into the boxes.

It is also known to fit a container directly to the lance, for example by screwing the mouth of the container to a socket provided on the lance. However, this entails the danger of spilling the herbicide, particularly if the herbicide is supplied to the user in a larger vessel, and has to be transferred by the user to the container which is fitted to the lance.

According to the present invention there is provided a method of manufacturing a container comprising a rigid housing part and a flexible wall, the method comprising:

(i) securing the flexible wall in a liquid-tight manner to a peripheral edge of the housing part;

(ii) subsequently causing the flexible wall to undergo plastic deformation into a predetermined configuration.

In a preferred embodiment, the rigid housing part and the flexible wall are made from compatible plastics materials, and are secured together by heat sealing. Also, the rigid housing part is preferably one of two such parts, the second housing part being secured, for example by heat sealing, to the assembly of the first housing part and the flexible wall to provide a rigid outer casing for the container, the interior of the casing being divided into two compartments by the flexible wall.

In order to assist plastic deformation of the flexible wall, it is preferably softened by heating before it is deformed.

The required configuration for the flexible wall may be achieved by deforming it into contact with a mould surface. The mould surface may comprise the surface of a moulding device superimposed over the flexible wall, on the side away from the housing part. The flexible wall may then be deformed into contact with the mould surface by applying suction between the mould surface and the flexible wall, and/or by admitting air into the cavity between the housing part and the flexible wall through an aperture in the housing part. The aperture may, for example, be intended to receive a fitting for enabling the flow of material into and out of the finished container.

In an alternative method, the mould surface may comprise the internal surface of the housing part. Thus, the flexible wall may be deformed by means of a former which is inserted into the housing part. Means may be provided for directing air, possibly heated air, at the flexible wall prior to, and during, the deformation step.

By securing the flexible wall to the housing part before the flexible wall is deformed, it is possible to avoid creasing of the flexible wall at the periphery of the housing part, which creasing could result in inadequate sealing and possible leakage.

By deforming the flexible wall, it is possible to impart to the flexible wall a configuration which will conform closely to the internal surface of the housing part so that the volume of the space between the housing part and the flexible wall can be reduced substantially to zero without creating tension in the flexible wall. Thus, substantially all of the contents of the container can flow from the container under gravity.

For a better understanding of the present invention, and to show how it may be carried into effect, reference will now be made, by way of example, to the accompanying drawings, in which.

Figure 1:
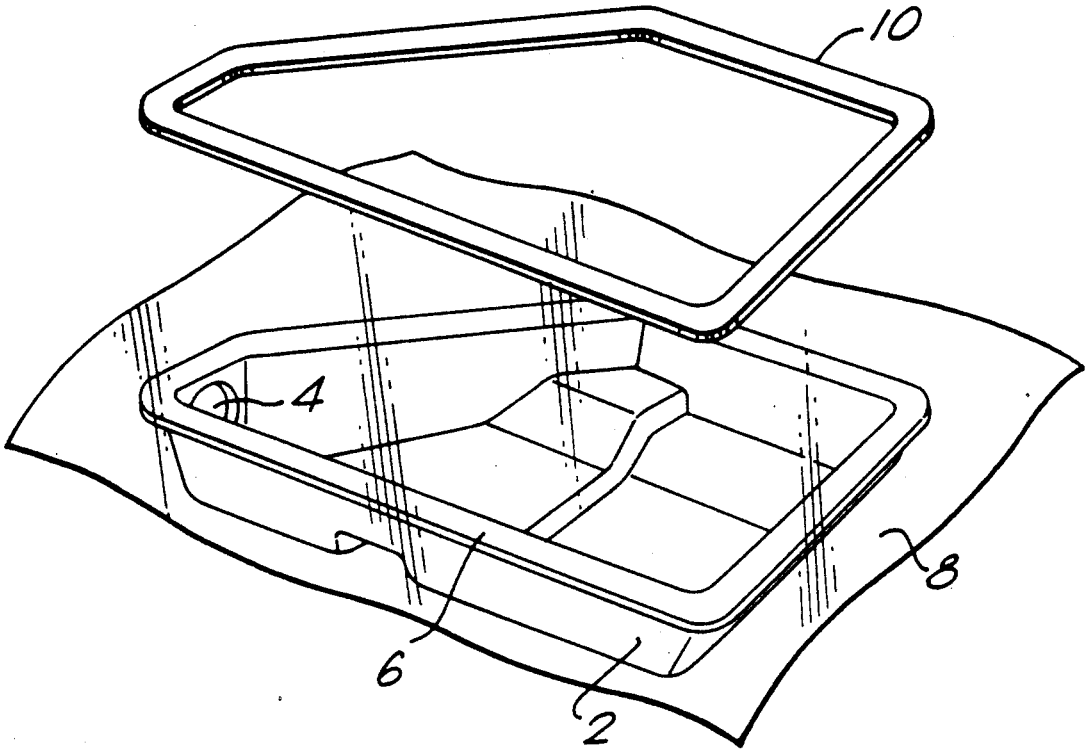
FIG. 1 is a diagrammatic perspective view of one stage in the manufacture of a container.

FIG. 1 shows a housing part 2 for a container. The housing part 2 is formed from plastics material and has a shape which enables the finished container to cooperate with a herbicide delivery lance in such a way that the container can be fitted to the lance to enable the contents of the container to be fed to a delivery head for distribution over the ground. The housing part 2 also has an aperture 4 which, in the finished container, receives a fitting through which the container is filled with herbicide, and through which the herbicide flows towards the delivery means.

The housing part 2 has a peripheral flange 6 which presents a flat sealing surface lying in a single plane. As shown in FIG. 1, a film 8 of flexible plastics material, such as low density polyethylene, is laid over the housing part 2 in contact with the flange 6. A heating ring 10 (shown only diagrammatically in FIG. 1, is brought down on to the film 8 over the flange 6, in order to heat seal the film 8 to the housing part 2. Excess material is then trimmed from the film 8, leaving a relatively taut wall of plastics material secured across the housing part 2.

Figure 2:
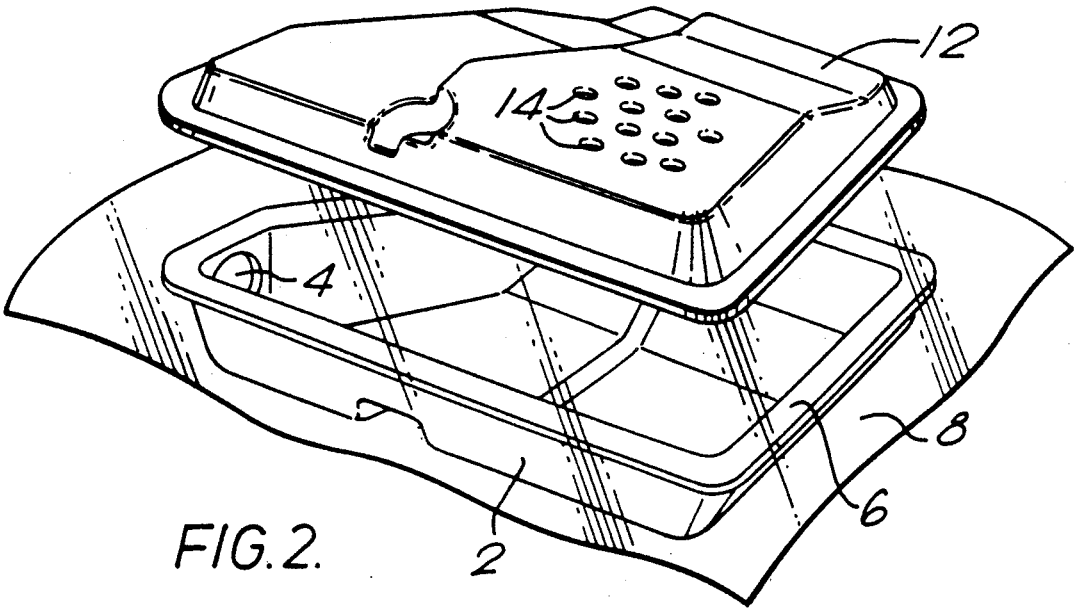
FIG. 2 is a diagrammatic perspective view of a second stage in the manufacture of a container.

Referring to FIG. 2 (which shows the film 8 untrimmed for clarity), a moulding device 12 is shown positioned a short distance above the housing part 2 with the attached flexible wall 8. The device 12 has an internal surface which is complementary to that of the housing part 2. Holes 14 are provided in the device 12 and are connected on the upper side of the device to air supply and extraction means (not shown).

The moulding device 12 is brought to a position a short distance (for example, approximately 3 mm) above the flexible wall 8, and hot air is directed at the flexible wall 8 through the holes 14. This heats the material of the wall 8, so softening it. When the flexible wall 8 is at a required temperature, the device 12 is lowered into contact with the flange 6 to provide an air-tight seal, and suction is applied to the holes 14 to draw the softened flexible wall 8 into contact with the mould surface on the device 12. At the same time, air is drawn into the housing part 2 through the aperture 4. It will be appreciated that, instead of applying suction to the holes 14, the flexible wall 8 could be displaced by admitting air under pressure through the hole 4, with the aperture 14 being vented.

By displacing the softened material of the flexible wall 8 into contact with the mould surface on the device 12, the material is stretched at various places, and undergoes plastic deformation. When the flexible wall 8 is cooled, for example by admitting cold air through the opening 4, the flexible wall 8 will retain the configuration of the mould surface on the device 12, although it will, of course, remain flexible.

Subsequently, cold air is admitted through the holes 14, to force the flexible wall 8 into contact with the internal surface of the housing part 2. A second housing part can then be secured, for example by heat sealing, to the peripheral flange 6, and an appropriate fitting can be inserted into the aperture 4. The second housing part preferably has a vent hole to allow air to flow into and out of the space between the flexible wall 8 and the second housing part.

The completed container can then be filled with products, such as herbicide, through the fitting in the aperture 4. During the filling process, the flexible wall 8 is displaced away from the interior surface of the housing part 2 into contact with the interior surface of the other housing part. Similarly, when the herbicide is withdrawn from the container, the flexible wall 8 moves back again towards the housing part 2, eventually ending up in close contact with that interior surface, thus enabling substantially all of the herbicide to be withdrawn.

Figure 3:
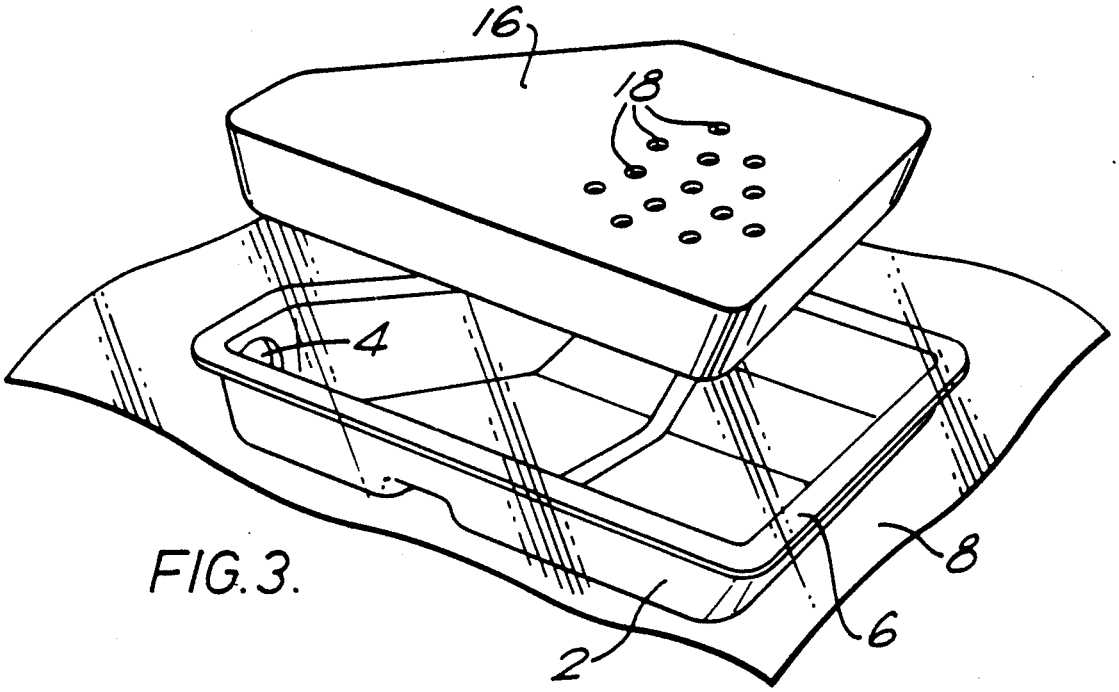
FIG. 3 corresponds to FIG. 2 but represents an alternative second stage.

FIG. 3 represents an alternative procedure for applying the required configuration to the flexible wall 8. In the embodiment of FIG. 3, the moulding device 12 is replaced by a former 16, for example of aluminium, provided with through holes 18.

After the flexible wall 8 has been secured to the peripheral flange 6, the former 16, which is heated, is lowered into contact with the flexible wall 8 so as to heat it, the heating effect being assisted by hot air introduced through the holes 18. As the former descends into the housing part 2, the softened flexible wall 8 is stretched, both by the former itself and by the air introduced through the holes 18, into close contact with the internal surface of the housing part 2. When the flexible wall 8 has made contact over the entire internal surface of the housing part 2, cold air is introduced through the holes 18 in order to cool the flexible wall 8, and cold air is also introduced through the aperture 4 in order to displace the flexible wall 8 away from the internal surface of the housing part 2. A second housing part is then applied to the housing part 2, and the container can then be filled with product as discussed above.

In order to improve sealing in the formed container, it may be desirable to include PTFE (polytetrafluorethylene) in the air flow through the aperture 4, in order to coat the internal surface of the cavity formed between the housing part 2 and the flexible wall 8.

I claim:

1. A method of manufacturing a liquid-filled container comprising a rigid housing, the interior of which is divided into two compartments by a flexible wall, the method comprising:

(i) securing the flexible wall in a liquid-tight manner to a peripheral edge of a first rigid housing part which first rigid housing part includes an opening for the passage of liquid;

(ii) causing the flexible wall to undergo plastic deformation into a predetermined configuration which is complementary to the internal configuration of the first housing part;

(iii) securing a second rigid housing part to the first rigid housing part to enclose the flexible wall, the second rigid housing part having a vent hole for the passage of air;

(iv) displacing the flexible wall against the internal surface of the first rigid housing part;

(v) filling the container with a liquid introduced through the opening in the first rigid housing part to cause the flexible wall to be displaced away from the internal wall of the first rigid housing part, air being vented through the vent hole in the second rigid housing part.

2. A method as claimed in claim 1, in which the flexible wall is secured to the peripheral edge of the housing part by heat sealing.

3. A method as claimed in claim 1, in which the flexible wall is softened by heating before deformation into the predetermined configuration.

4. A method as claimed in claim 1, in which the flexible wall is deformed by forcing it into contact with a mould surface.

5. A method as claimed in claim 4, in which the mould surface is provided on a moulding device engaged with the housing part.

6. A method as claimed in claim 5, in which the flexible wall is deformed by withdrawing air, through holes provided in the moulding device, from the cavity defined between the flexible wall and the moulding device.

7. A method as claimed in claim 5, in which the flexible wall is deformed by admitting air, through an aperture in the housing part, into the cavity defined between the housing part and the flexible wall.

8. A method as claimed in claim 4, in which the mould surface comprises the internal surface of the first rigid housing part.

9. A method as claimed in claim 8, in which the flexible wall is deformed into contact with the internal surface of the first rigid housing part by means of a former which is inserted into the housing part.

10. A method as claimed in claim 9, in which means is provided for blowing air through the former at the flexible wall.

11. A method as claimed in claim 9, in which means is provided for heating the former.

12. A method as claimed in claim 1, in which the liquid with which the container is filled is a herbicide.

* * * * *

UNITED STATES PATENT AND TRADEMARK OFFICE

CERTIFICATE OF CORRECTION

PATENT NO. : 4,987,725

DATED : 29 January 1991

INVENTOR(S) : David C. Gill

It is certified that error appears in the above-identified patent and that said Letters Patent is hereby corrected as shown below:

On the title page, in item [54], and in column 1, lines 1-4:
In the title, please delete "CONTAINER" and insert --CONTAINERS--.

Signed and Sealed this

Thirtieth Day of June, 1992

*Attest:*

DOUGLAS B. COMER

*Attesting Officer*

*Acting Commissioner of Patents and Trademarks*